United States Patent [19]

Clark, Jr.

[11] Patent Number: 4,635,711

[45] Date of Patent: Jan. 13, 1987

[54] DOUBLE WALL HEAT EXCHANGER

[75] Inventor: John A. Clark, Jr., East Stroudsburg, Pa.

[73] Assignee: Harsco Corporation, Wormleysburg, Pa.

[21] Appl. No.: 702,228

[22] Filed: Feb. 15, 1985

[51] Int. Cl.[4] ..... F28F 11/00

[52] U.S. Cl. ..... 165/70; 165/158; 285/13

[58] Field of Search ..... 165/70, 134 R, 158; 285/13, 14; 29/157.4

[56] References Cited

U.S. PATENT DOCUMENTS

| | | | |
|---|---|---|---|
| 1,447,518 | 3/1923 | Safberg . | |
| 1,852,489 | 4/1932 | Sullivan . | |
| 1,961,907 | 6/1934 | Mott | 257/238 |
| 2,187,555 | 1/1940 | Flindt | 165/70 |
| 2,365,515 | 12/1944 | Baudry | 165/70 |
| 2,441,344 | 5/1948 | Bosworth | 165/70 |
| 2,545,280 | 3/1951 | Hollmeyer et al. | 257/247 |
| 2,703,921 | 3/1955 | Brown, Jr. | 29/157.3 |
| 2,730,337 | 1/1956 | Roswell | 257/246 |
| 2,768,813 | 10/1956 | Boyer | 165/70 |
| 3,074,480 | 1/1963 | Brown, Jr. et al. | 165/154 |
| 3,386,497 | 6/1968 | Feldmeier | 165/11 |
| 3,568,764 | 3/1971 | Newman et al. | 165/134 |
| 3,605,883 | 9/1971 | Nalbone | 165/178 |
| 3,651,551 | 3/1972 | Cannon | 29/157.3 C |
| 3,706,343 | 12/1972 | Saiga et al. | 165/70 |
| 3,830,290 | 8/1974 | Thamasett et al. | 165/70 |
| 3,948,315 | 4/1976 | Powell | 165/70 |
| 4,054,981 | 10/1977 | Bridgegum | 29/157.3 |
| 4,194,560 | 3/1980 | Matsuzaki | 165/141 |
| 4,210,199 | 7/1980 | Doucette et al. | 165/70 |
| 4,237,968 | 12/1980 | Duke | 165/70 |
| 4,242,877 | 1/1981 | Geerkens | 62/93 |
| 4,252,182 | 2/1981 | Fender | 165/11 R |
| 4,275,784 | 6/1981 | Popplewell et al. | 165/134.1 |

FOREIGN PATENT DOCUMENTS

| | | | |
|---|---|---|---|
| 1117148 | 1/1958 | Fed. Rep. of Germany | 165/70 |
| 549428 | 10/1956 | Italy | 165/70 |
| 168097 | 12/1981 | Japan | 165/70 |
| 703081 | 1/1954 | United Kingdom | 165/70 |
| 728592 | 4/1955 | United Kingdom . | |
| 730284 | 5/1955 | United Kingdom . | |

*Primary Examiner*—Albert W. Davis, Jr.
*Assistant Examiner*—Peggy A. Neils
*Attorney, Agent, or Firm*—Kerkam, Stowell, Kondracki & Clarke

[57] ABSTRACT

In a heat exchanger employing double wall tubing comprising concentric inner and outer tubes, the inner and outer tubes are disposed within apertures of spaced tube sheets and connected thereto by roller expansion of the tubes. To maintain venting of the air space between the tubes, a split wall ferrule is located over the inner tube and within the outer tube in the region of the tube sheet to which the outer tube is connected. The ferrule, which has a length sufficient to traverse the thickness of the tube sheet, transmits expansion forces exerted on the interior of the inner tube to the outer tube so as to expand the outer tube to connect it to the tube sheet. The split in the ferrule wall forms a passageway that connects the air space between the tubes to the space between the tube sheets.

20 Claims, 3 Drawing Figures

DOUBLE WALL HEAT EXCHANGER

BACKGROUND OF THE INVENTION

This invention relates to heat exchangers and the like having a double wall tubing construction.

There are a number of heat exchanger applications where it is necessary or desirable to provide double wall protection between fluid streams to avoid contamination of one fluid stream by the other due to breaks, pinholes or leaks in the heat exchanger tubing. This is true, for example, for heating or refrigeration systems which handle potable water, where it is necessary to avoid contamination of the potable water by the heat exchange fluid from a boiler, a solar panel, a refrigeration unit, or the like. Heat exchangers for such applications employ double wall tubing comprising a pair of concentric, coaxially arranged inner and outer tubes having an air space between the tubes. The inner tube may carry, for example, heat exchange fluid, and the outer tube may be in contact with the potable water. If a leak occurs in either the inner or the outer tubes, water or heat exchange fluid will flow into the air space, which is generally vented to the atmosphere, and flow out of the system, thereby providing leak detection. To enhance heat transfer between the water and the heat exchange fluid, mechanical connection between the inner and outer tubes may be provided to enable heat transfer by conduction. One type of double wall tubing available from Noranda Metal Industries, Inc. provides such mechanical connection by forming the inner surface of the outer tube with a plurality of ribs which contact the outer surface of the inner tube. Another type of double wall tubing available from Doucette Industries, Inc. and described in U.S. Pat. No. 4,210,199 has spiral grooves or indentations in the outer tube which deform the inner surface of the outer tube into contact with the inner tube. Currently available heat exchangers employing such tubing are generally of the double pipe type, as shown in the above-referenced patent, wherein the tubing extends through a plurality of substantially parallel pipes interconnected by headers or manifolds. Although such constructions may be acceptable for small capacity systems, they are not cost effective for larger systems.

In larger systems, it is desirable to use a shell and tube type of construction, wherein a plurality of parallel tubes are supported along their length by tubes supports and at their ends by a tube sheet, and are disposed within a tank or a shell containing potable water. In order to employ double wall tubing in such a heat exchanger, it is necessary to employ two spaced tube sheets at the ends of the tubes, one connected to the outer tubes and one connected to the inner tubes. Providing a suitable connection between the tubes and the tube sheets, however, has proved to be a significant problem, particularly for connecting the outer tube to the inner tube sheet. Although compression-type fittings may be employed, they are expensive and use surface area inefficiently due to the necessity of providing sufficient space between the fittings to enable them to be tightened. Moreover, if leaks should develop after the system has been assembled, there is no convenient way to get to the fittings located between the tube sheets to enable the fittings to be tightened. Welding, brazing, or soldering of the tubes to the tube sheets is difficult to perform without closing off the air space between the tubes, or burning the inner tube, and has other disadvantages, particularly if the tubes and the tube sheets are of different materials. As with compression fittings, there is also no convenient way to correct a leak at the inner tube sheet after the heat exchanger has been assembled.

Although the inner tubes may be connected to the outer tube sheet by roller expanding the tubes, the outer tubes cannot be connected to the inner tube sheet using known roller expansion techniques since this would result in closing off the air space.

It is desirable to provide a heat exchanger construction and method which avoid the foregoing problems, and it is to this end that the present invention is directed.

SUMMARY OF THE INVENTION

The invention affords a heat exchanger employing double wall tubing, and a method of constructing the same, that avoid the foregoing and other disadvantages of presently known heat exchangers and construction methods. In accordance with the invention, the inner and outer tubes of the double wall tubing are conveniently and easily connected to their corresponding tube sheets without the use of compression fittings or welding techniques, and in such a manner that the air space between the tubes is not closed off, thereby enabling venting of the air space and leak detection to be maintained. Furthermore, the connection is such that leaks developing after the heat exchanger has been assembled may be quickly and easily repaired.

Briefly stated, in one aspect, the invention affords a heat exchanger and a method of constructing the heat exchanger wherein the inner and outer tubes of double wall tubing are connected, respectively, to spaced outer and inner tube sheets that are formed with apertures therein for receiving the ends of the tubes by roller expansion of the tubes. To enable roller expansion of the outer tube to connect it to the inner tube sheet without closing off the air space between the tubes, a split-wall ferrule is disposed over the inner tube and within the end of the outer tube that is received within the inner tube sheet. The ferrule enables the forces exerted by a parallel roller expander or similar device inserted into the inner tube to be transmitted to the outer tube so as to expand the outer tube and provide a fluid-type connection between the outer tube and the inner tube sheet. The slit in the wall of the ferrule affords a passageway that connects the air space between the tubes with an air space between the spaced tube sheets. During expansion of the outer tube, the ferrule is also expanded, causing the slit in its side wall (and the passageway) to widen, thereby ensuring that venting of the air space between the tubes is maintained.

DESCRIPTION OF THE PREFERRED EMBODIMENT

The invention is particularly well adapted to the construction of heat exchangers and the like employing double wall tubing, and will be described in that environment. However, as will be appreciated from the description that follows, this is illustrative of only one utility and, in general, the invention is applicable in other areas requiring the connection of a double wall tube to a plate.

Figure 1:
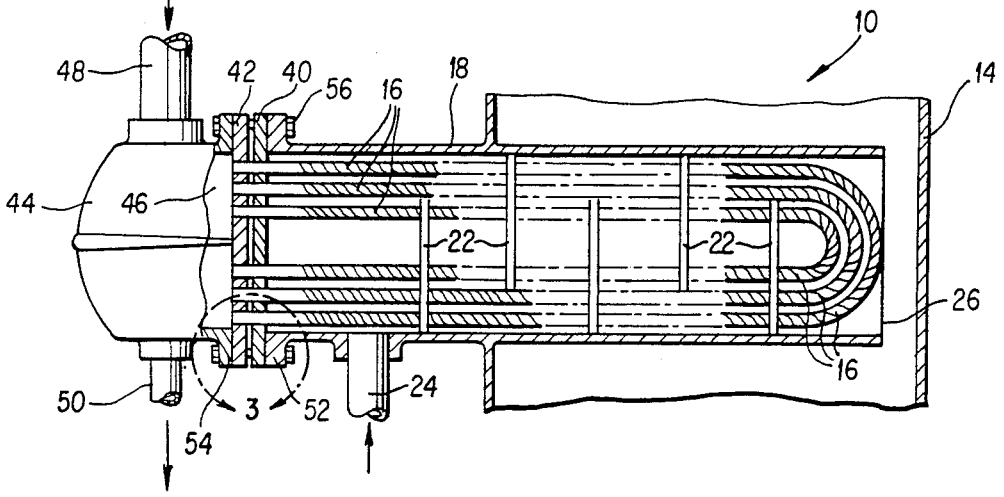
FIG. 1 is a cross sectional view, partially broken away, of a portion of a water heater employing a heat exchanger in accordance with the invention.

FIG. 1 illustrates a portion of one form of a water heater 10 employing a heat exchanger 12 in accordance with the invention. As shown, the water heater may comprise a first shell 14 that constitutes a tank for holding potable water. In the form illustrated, heat exchanger 12 may comprise a plurality of U-shaped tubes 16 disposed within a second shell 18 which extends into the tank. Shell 18, which may be cylindrical, serves as a housing for the heat exchanger tubes. The tubes may be supported within the housing by a plurality of tube supports 22 which also serve as flow control baffles to ensure that cold water entering an inlet 24 of the housing is evenly distributed and circulated over the heat exchanger tubes. The end 26 of the housing within the tank is open to enable the water flowing through the heat exchanger to be discharged into the tank.

Figure 2:
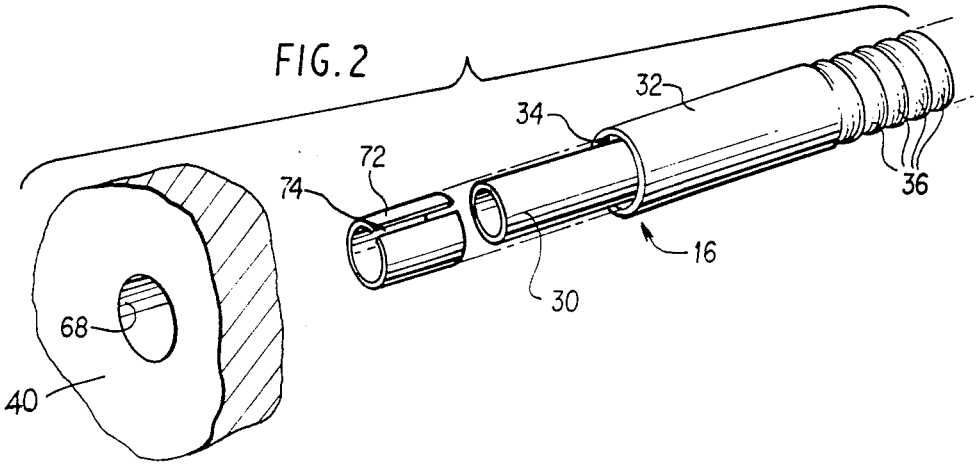
FIG. 2 is an enlarged exploded perspective view of a portion of the heat exchanger of FIG. 1 illustrating the manner in which a double wall tube is connected to a tube sheet.

Heat exchanger tubes 16 are double wall tubes which may be of the type disclosed in the previously referenced U.S. Pat. No. 4,210,199, and available from Doucette Industries, Inc. As best shown in FIG. 2, each tube 16 comprises an inner tube 30 coaxially disposed within an outer tube 32. The respective diameters of the tubes are such that an annular air space 34 is provided between the outer surface of the inner tube and the inner surface of the outer tube, and the outer tube may be formed with indentations 36 (in a spiral pattern, for example) over a portion of its length to provide mechanical connection between the inner and outer tubes and to enable heat transfer through conduction. The ends of the outer and inner tubes of each tube 16 terminate in and are connected to spaced inner and outer tube sheets 40 and 42, respectively, as will be described shortly. As is shown in FIG. 1, inner tube sheet 40 serves as an end wall of heat exchanger housing 18, and outer tube sheet 42 serves as one wall of another housing 44 which forms a chamber 46 for a heat exchange fluid, such as steam from a boiler or the like (not illustrated), that enters the chamber through an inlet 48. The steam or other heat exchange fluid entering chamber 46 flows through the inner tubes 30 of the heat exchanger tubes 16 which are connected to tube sheet 42 such that they are in communication with chamber 46, as will be described, to enable heat transfer between the water entering inlet 24 and the heat exchange fluid flowing through the tubes. Housing 44 may further have an outlet 50 as shown for condensate.

As indicated above, the double wall tubes have the advantage of enabling early detection of leaks so that contamination of the water by the heat exchange fluid can be avoided. In the event that breaks, pinholes or other leaks occur in the tubes, the water or heat exchange fluid, which is under pressure, will flow into the air space between the tubes. By venting the air space to the atmosphere, the leaking water or fluid will be expelled from the system and can be detected. However, for this to occur, it is necessary that the tubes be connected to the tube sheets in such a manner that a passageway through the tube sheet to the air space is provided so that venting can be maintained. The provision of such a passageway is the major problem faced in connecting the outer tube to the inner tube sheet. Heat exchangers of the type to which the invention pertains typically comprise bundles of several hundred, for example, closely spaced heat exchanger tubes that must be terminated in the tube sheets. Accordingly, it is desirable that the tubes be connected to the tube sheets in an economical, easy to accomplish manner which efficiently utilizes the surface area of the tube sheets. Furthermore, since the tube sheets form walls of heat exchanger chambers which contain the water or other fluid that is typically under pressure, the connections must be fluid-tight and are preferably such that repairs can be easily made in the event that leaks develop between the tubes and the tube sheets. As noted earlier, compression fittings and welding techniques are unsatisfactory, and providing a connection that affords the desired characteristics has represented a long-standing problem in the art. Significantly, the invention solves this problem by affording a rather simple, economical connection that accomplishes the desired objectives, as will now be described.

Figure 3:
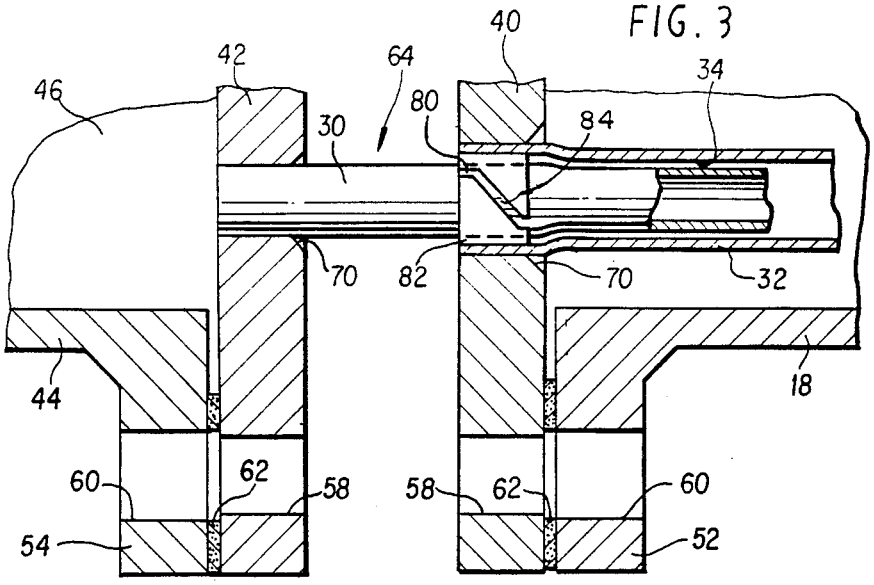
FIG. 3 is an enlarged cross sectional view of a portion of the heat exchanger of FIG. 1 within the dotted circular line 3 illustrating the connection of the inner and outer tubes of a double wall tube to corresponding tube sheets.

FIGS. 2 and 3 illustrate in greater detail the construction of the heat exchanger in the vicinity of the tube sheets and the manner in which the tubes are connected to the sheets. Each tube sheet comprises a plate having a plurality of apertures therein which are sized to receive the ends of the tubes. As best illustrated in FIG. 3, the inner and outer tube sheets 40 and 42, respectively, are disposed in spaced relationship to one another, and may be connected, respectively, to a flange 52 of heat exchanger housing 18 and to a flange 54 of housing 44, as by a bolt 56 (see FIG. 1) passing through aligned holes 58 and 60 in the tube sheets and the flanges, respectively. A seal 62 may be disposed between each tube sheet and its respective flange, and the tube sheets constitute the end walls of housings 18 and 44, as previously noted. The tube sheets may be held in spaced relationship by spacers, e.g., washers or the like, or by an annular plate (not illustrated) disposed between the tube sheets. The air space or chamber 64 between the tube sheets is in communication with the air space 34 between the tubes, as will be described, and is vented to the atmosphere so that if a leak occurs either between the inner and the outer tubes or between the tubes and their respective tube sheets, fluid will flow into chamber 64 and be expelled from the chamber to enable the leak to be detected.

As previously noted, the tube sheets are formed with aligned holes for receiving the ends of the tubes, as shown, for example, in FIG. 2 which illustrates a hole 68 in the inner tube sheet 40 for receiving the end of an outer tube 32. As best illustrated in FIG. 3, the end of inner tube 30 extends beyond the end of outer tube 32 by a distance at least sufficient to enable the inner tube to be received in the outer tube sheet and to be connected thereto when the outer tube is connected to the inner tube sheet. Preferably, the inner tube extends beyond the outer tube by at least the distance between the tube sheets plus the thickness of the outer tube sheet so that the inner tube may be completely received within its corresponding hole in the outer tube sheet, as shown. Although the ends of the inner and outer tubes are shown in FIG. 3 to be flush with the surfaces of their corresponding tube sheets, the ends may, if desired, extend somewhat beyond the surfaces. The holes in the tube sheets may be chamfered, as indicated at 70, on the side from which the tubes enter to facilitate placement of the tubes within the holes.

In accordance with the invention, each tube is connected to its corresponding tube sheet by roller expansion of the tube, as by employing a conventional parallel roller expander or similar device, so as to form a fluid-type connection between the tube sheet and the tube. In order to avoid closing off the air space 34 between the tubes when the outer tube is rolled, a split-wall ferrule 72 (one form of which is shown in FIG. 2) is disposed over the inner tube and within the outer tube adjacent to the end of the outer tube. The ferrule, which comprises a tubular sleeve having a slit or an opening in its wall, is sized so that it may be easily positioned over the inner tube and inserted into the annular air space 34 between the tubes. Preferably, the ferrule has a thickness approximately equal to the radial distance of the annular air space between the tubes, and has a length that is at least equal to and preferably greater than the thickness of the inner tube sheet so that its ends extend beyond the opposite sides of the inner tube sheet, as illustrated in FIG. 3. This avoids the necessity for precisely aligning the ferrule within the outer tube and ensures that it traverses the length of the tube which is rolled. The ferrule permits the forces produced by a parallel roller expander or the like inserted into the end of the inner tube to be transmitted to the outer tube to expand the outer tube and connect it to the inner tube sheet. However, the slit 74 in the ferrule provides a passageway that connects the annular air space between the tubes with the air space 64 between the tube sheets so that venting of the annular air space between the tubes is maintained. Since the ferrule (as well as the inner tube) is also expanded during rolling, the slit 74 in the wall of the ferrule tends to widen during rolling, thereby widening the passageway connecting the annular air space between the tubes and the air space between the tube sheets.

FIGS. 2 and 3 illustrate ferrules having somewhat different slit configurations. In FIG. 2, slit 74 in ferrule 72 comprises a straight axially extending slit. Although this is satisfactory, it is preferred that at least a portion of the slit extend at an angle to the axis of the ferrule, as shown, for example, in FIG. 3 where slit 80 of ferrule 82 is somewhat Z-shaped and has a portion 84 that extends diagonally relative to the axis of the ferrule. By employing a slit configuration that extends at an angle to the axis, areas of possible weakness in the rolled connection can be avoided and a better connection between the outer tube and the inner tube sheet can be provided. Other types of slit configurations which may be employed include a sinuous configuration, for example.

The ferrule may be formed by spliting the wall of a seamless tube to form a slit of the desired configuration, or by rolling a flat or planar piece of material into a tubular shape. The ferrule may be formed of an annealed material which may be easily rolled, and is preferably of a material that is rust and corrosion resistant to prevent the passageway from closing up after a period of time. Suitable materials are non-ferrous metals such as brass or bronze, as well as annealed stainless steel alloys.

A significant advantage of the invention is that, after the heat exchanger has been assembled, if a leak between the tubes and the tube sheets is detected during testing, or occurs after a period of use, it may be easily and quickly repaired by rerolling the tubes without necessity of disassembling the heat exchanger. Moreover, the invention enables the heat exchanger tubes to be bundled very close to one another, which permits very efficient use of space, and is particularly advantageous from a cost and ease of assembly standpoint.

Although the invention has been described in the context of a heat exchanger for use in a water heater, it will be appreciated from the foregoing that the principles of the invention are also applicable to heat exchangers employed for other purposes, e.g., in refrigeration units, as well as to other types of devices that require the connection of a double wall tube to a plate. Also, while heat exchanger 12 of FIG. 1 employs U-shaped tubes disposed within a shell or a housing, it will be appreciated that the heat exchanger may be configured as a plurality of straight tubes, in which case inner and outer tube sheets would be employed on each end of the tube bundle, and the heat exchanger tubes may be disposed directly in a tank without a supporting housing.

While a preferred embodiment of the invention has been shown and described, it will be appreciated by those skilled in the art that changes may be made in this embodiment without departing from the principles and spirit of the invention, the scope of which is defined in the appended claims.

What is claimed is:

1. A method of connecting a double wall tube of the type having an inner tube coaxially disposed within an outer tube so as to define a space therebetween to a plate so as to vent the space between the tubes, the method comprising disposing an end of the outer tube within an aperture in the plate; locating a ferrule over the inner tube and within the outer tube at the end of the outer tube, the ferrule having a slit from a first end of the ferrule to a second end thereof; and expanding simultaneously the inner and outer tubes and the ferrule so as to expand and connect the outer tube to the plate and expand the slit in the ferrule to define a passageway through the plate that connects the space between the tubes to another space surrounding the end of the outer tube and adjacent to a surface of the plate.

2. The method of claim 1 further comprising providing another plate spaced from the first-mentioned plate, the spacing between the plates comprising said other space surrounding the end of the outer tube, disposing an end of the inner tube within an aperture in said other plate, and roller expanding the inner tube so as to connect such tube to the other plate.

3. A method of constructing a heat exchanger using double wall tubing of the type having an inner tube coaxially disposed within an outer tube so as to define a space therebetween, the inner tube having an end extending beyond an end of the outer tube, the method comprising providing first and second spaced plates having apertures therein and defining a chamber therebetween; locating a ferrule having a split wall over the inner tube and within the outer tube at the end of the outer tube; disposing the ends of the inner and outer tubes in the apertures in the first and second plates, respectively; connecting the inner tube to the first plate; and expanding simultaneously the inner and outer tubes and the ferrule in the region of the second plate so as to connect the outer tube to the second plate and such that the split in the ferrule wall expands to define a passageway that connects the chamber with the space between the tubes to vent such space to the chamber.

4. The method of claim 3, wherein connecting the inner tube to the first plate comprises roller expanding the inner tube.

5. The method of claim 3, wherein said tubes have a substantially circular cross section and the space between the tubes is substantially annular in cross section.

6. The method of claim 3, wherein the split in the wall of the ferrule extends in a substantially axial direction of the ferrule such that the passageway is substantially axial.

7. The method of claim 3, wherein the split in the wall of the ferrule extends at an angle to an axis of the ferrule.

8. The method of claim 7 further comprising forming said ferrule by rolling a piece of substantially planar material into a substantially tubular shape, the material having opposite ends with a matching configuration such that upon the material being rolled into said tubular shape the space between said opposite ends defines the split.

9. The method of claim 3 further comprising venting said chamber to the atmosphere.

10. The method of claim 3 further comprising disposing the tubing within a shell containing a first fluid such that the fluid is in contact with the surface of the outer tube, and providing a flow of a second fluid through the inner tube so as to transfer heat between said first and second fluids.

11. The method of claim 10, wherein said first fluid is potable water, and said second fluid has a temperature different from the temperature of the water.

12. A heat exchanger comprising an inner tube coaxially disposed within an outer tube so as to define a space therebetween, the inner tube having an end extending beyond an end of the outer tube; first and second spaced plates having apertures therein and defining a chamber therebetween, the end of the inner tube being disposed within the aperture in the first plate and being connected to the first plate and the end of the outer tube being disposed within the aperture of the second plate; and a ferrule disposed over the inner tube and within the outer tube at the end of the outer tube within the aperture of the second plate, the ferrule having a slit therein; and the inner tube, the ferrule and the outer tube all being expanded within the aperture of the second plate such that the outer tube is connected to the second plate and such that said slit in the ferrule is expanded and defines a passageway that connects said chamber with the space between the tubes to vent such space to said chamber.

13. The heat exchanger of claim 12, wherein the space between the tubes is substantially annular, and said ferrule comprises a substantially tubular member having a thickness substantially equal to the space between the tubes and having a length at least equal to the thickness of the second plate, the ferrule being positioned relative to the aperture in the second plate so as to transmit expansion forces exerted on the interior of the inner tube to the outer tube in order to expand the outer tube into connection with the second plate.

14. The heat exchanger of claim 13, wherein said slit extends in a substantially axial direction of said ferrule such that said passageway is substantially axial.

15. The heat exchanger of claim 13, wherein said split extends at an angle to an axis of the ferrule.

16. The heat exchanger of claim 12, wherein the tubes extend from said first and second plates into a first shell containing a first fluid, and a second shell is connected to the first plate so as to define another chamber on the opposite side of the first plate from said first-mentioned chamber, the inner tube being in communication with said other chamber and the other chamber containing a second fluid which flows through the inner tube.

17. The heat exchanger of claim 16, wherein said first fluid is potable water, and said second fluid is at a temperature different from the temperature of the water.

18. The heat exchanger of claim 12, wherein the ferrule is formed from an annealed corrosion and rust resistant metal.

19. The heat exchanger of claim 12, wherein the inner tube is connected to the first plate by expansion of the end of the inner tube within the aperture of the first plate.

20. The heat exchanger of claim 12, wherein there is a plurality of such inner and outer tubes disposed in substantially parallel relationship to one another and connected to the first and second plates.

* * * * *